United States Patent [19]

Rex

[11] 4,214,504

[45] Jul. 29, 1980

[54] COMPOUND DRUM

[76] Inventor: Leslie A. Rex, 2036 Chestnut St., Philadelphia, Pa. 19103

[21] Appl. No.: 900,808

[22] Filed: Apr. 27, 1978

[51] Int. Cl.[2] ..... G10D 13/02

[52] U.S. Cl. ..... 84/411 R

[58] Field of Search ..... 84/411–417, 84/419–420

[56] References Cited

U.S. PATENT DOCUMENTS

| | | | |
|---|---|---|---|
| 150,814 | 5/1874 | Belknap | 84/414 |
| 1,233,881 | 7/1917 | Iucci | 84/419 X |
| 2,338,816 | 1/1944 | Lockhart | 84/411 P |
| 3,956,959 | 5/1976 | Ebihara et al. | 84/1.15 |
| 4,048,895 | 9/1977 | May | 84/411 A |
| 4,111,094 | 9/1978 | Broser | 84/411 R |

*Primary Examiner*—Lawrence R. Franklin

*Attorney, Agent, or Firm*—Paul & Paul

[57] ABSTRACT

A musical instrument being, preferably, a compound drum, is provided having a plurality of distinct percussion chambers which may be contiguously incorporated into a single drum shell under a single continuous drum head, wherein this head may include a plurality of distinct surfaces.

10 Claims, 5 Drawing Figures

COMPOUND DRUM

BACKGROUND OF THE INVENTION

This invention relates to musical instruments of the drum or percussion type, and more specifically, relates to musical drums which are normally struck by the fingers or palm of the hand. Such drums are of the conga and bongo types.

Drum structures normally include a cylindrical shell or drum cylinder. A head, generally made of animal skin or synthetic substitute, tautly covers at least one end of the drum cylinder. Tensioning devices are utilized to keep the head in place and to adjust the tension of the head. Very often the drum cylinder will be opened at two ends. This second end will also be covered by a head held in place by tensioning devices or will be left open.

The structure and design of an individual drum varies as a function of its intended purpose and process of its manufacture. Very early drums were made from hollow logs and were used as signaling devices while more modern drums have been made as musical instruments. It is desirable that a drum intended for musical purposes have pleasing tone qualities and be adjustable as to pitch.

Previously, drums were designed to each produce basically a single sound or narrow range of sounds. As such, the drum shell or cylinder was shaped to effect the acoustic production of sound in response to a striking of the drum head. Invariably, these drums have each had a single-surfaced, planer head. Drum tone was determined by the acoustical porperties of the drum shell and head tension. Drum shell shape, size and material of construction also affected the tone qualities as well as influenced the manner in which the drum was to be played.

Some drums are intended to be played with sticks, while others are to be played with mallets, hammers or brushes, and even others are to be played with the fingers and palm of the hand.

As drums are constructed with a specific musical tone or frequency range in mind, any one given musical drum possesses, obviously, a rather limited tone spectrum.

It is an object of this invention to provide a musical percussion instrument of the drum type which is intended to be played primarily with the fingers and palm of the hand having extended tonal qualities over an extended frequency range.

A second object of this invention is to provide such a drum with a plurality of percussion chambers, these chambers contributing to a different tone or frequency range of sounds when the head above them is struck.

Another object of this invention is to provide such a drum with multiple contiguous percussion chambers formed as part of a single continuous housing or shell.

A further object of this invention is to provide such a drum with a single membrane head, this head defining a plurality of complex distinct surfaces.

An even further object of this invention is to provide such a drum head with a dampening point between at least two different percussion chambers, which percussion chambers each define a distinct drum function.

SUMMARY OF THE INVENTION

The objectives of this invention may be realized in a compound drum having a plurality of percussion chambers contiguously situated to one another whose individual shells or drum cylinders may be formed as part of a single continuous housing. Distinct drum chambers may be of regular or irregular cylindrical shapes.

The single continuous housing may have a cylindrical outer shape, parted at one end orthogonally to the outer side wall, in such a manner that the side walls of each of the individual percussion chambers may be similarly terminated at that end, in the same plane as the termination of the outer side wall. The other end of the drum, comprising the intended playing end thereof, may be parted so that the end of the outer side wall and the end of the walls of the individual percussion chambers transcribe a truncated frustroconical surface.

A single membrane head may cover the playing end of the drum. When stretched over this end, this head defines a truncated frustroconical playing surface which may have vibration dampening points at pinch locations between two or more percussion chambers.

A single clamping rim may hold the playing head in place. This clamping rim may have independent tightening bolts which may be independently adjusted to tune different drum functions into the instrument by tightening the head surface above different percussion chambers.

Drum housing thickness between adjacent percussion chambers may be varied from individual musical instrument to musical instrument, or may be varied within certain areas of the same musical instrument to alter the cross harmonics radiating between adjacent percussion chambers.

A rigid plate, being either solid or containing a selected plurality of precisely positioned vent holes may be placed over the nonplaying end of the drum to mute or otherwise tune the instrument in octave increments.

DESCRIPTION OF THE DRAWINGS

The operation, features and advantages of this invention will readily become apparent from a reading of the following detailed description of the invention in conjunction with the accompanying drawings in which like numerals refer to like elements and in which.

DETAILED DESCRIPTION OF THE INVENTION

Figure 1:
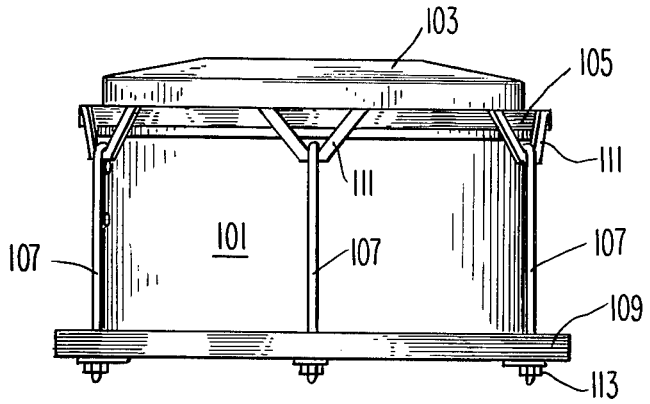
FIG. 1 is a side view of the outside of the drum showing the truncated frustroconical head.

A drum intended to be played primarily with the hand and producing sounds in part similar to the drums in the bongo and conga families as well as an additional extended range of sounds may be constructed as shown in FIG. 1. The drum 100 being capable of providing the mixture of sounds is actually a compound instrument having a housing or shell 101 with a cylindrical outer wall. The playing end of the drum has a truncated frustroconical surface over which is stretched the playing head 103.

A tensioning rim 105 holds the head 103 securely to the drum shell 101. This tensioning rim 103 slips over the outer diameter of the shell 101 to draw the head 103 taut. Tensioning rim 105 is secured by a plurality of tension rods 107 to a bottom rim ring 109 which seats against the orthogonal or squared off bottom end of the shell 101. The tensioning rods 107 each have a hook-shaped portion at one end and a threaded section at the other end. The hook portion of each of the rods 107 is secured to the tensioning rim 105 by hooking into a mating V-shaped loop 111 extending from the tensioning rim 105. The threaded portion of each tensioning rod 107 extends through an appropriate hole in the bottom rim ring 109 to be mated with a hexagonally-shaped nut 113 which is tightened on that tensioning rod 107, therefore drawing the tensioning rim 105 and tightening the head 103.

Figure 2:
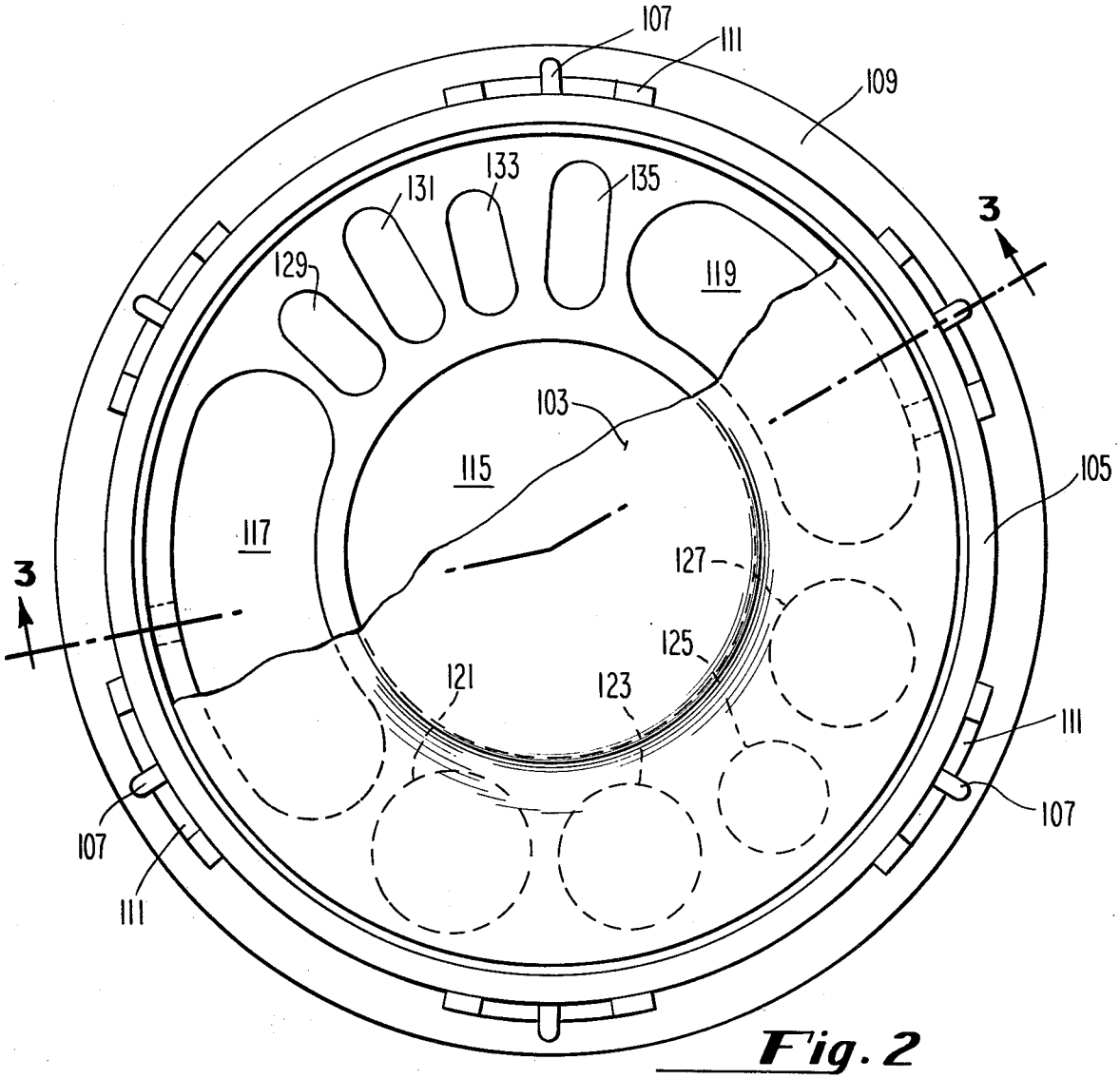
FIG. 2 is a cutaway top view showing the drum head and the plurality of percussion chambers within the single housing.

FIG. 2 shows in greater detail the configuration of the preferred embodiment from a cutaway top view. Here the tensioning ring 105 is held down by six evenly spaced tensioning rods 107 secured to the rim 105 by hooking into mating V-loops 111. The drum shell 101 is actually a drum housing having a plurality of holes drilled or otherwise formed therethrough. Each hole functions as an individual percussion chamber.

Situated concentrically in the center of the shell housing 101 is a round or cylindrical chamber 115 extending completely through the housing 101. Situated on either side of this center cylindrical percussion chamber 115 about its periphery is a pair of percussion chambers 117, 119 each having an irregular shape. These side chambers 117, 119 are cylindrical and have a kidney-shaped or almost peanut-shaped cross section.

Extending through the housing 101 about the periphery of the center chamber 115 and in-between the pair of kidney-shaped chambers 117, 119 is a plurality of four small, round cylindrical percussion chambers 121, 123, 125 and 127. Extending through the housing 101 on the opposite side of the periphery of center percussion chamber 115 from the small cylindrical chambers 121, 123, 125 and 127 is a plurality of four oblong-shaped cross section percussion chambers 129, 131, 133 and 135.

In this preferred embodiment, the center percussion chamber 115 having a large cylindrical shape is played much like a conga drum, and depending upon its size, may generate bongo sounds. The kidney-shaped percussion chambers 117 and 119 form additional drums which may be played with the fingers and palms as is the center chamber 115 or with the sides of the hands; their general cross-sectional shape being of a configuration which is easily played with the side of the hand. The oblong chambers 119, 131, 133 and 135 can be played with the extended fingers of the hand, there being four of them evenly spaced at distances convenient for striking with the four fingers of the hand. The small round chambers 121, 123, 125, 127 may be played individually with the tips of the fingers or with the middle portions of the fingers and palm of the hand.

As an example of relative sizes, the drum housing 101 can be 400 millimeters in diameter with the center chamber 115 being 150 millimeters in diameter. Each of the kidney-shaped chambers 117, 119 has a 25 millimeter radius at either end and has a 50 millimeter width. Small chamber 121 and small chamber 127 are each 60 millimeters in diameter while small center chambers 123 and 125 are 50 and 40 millimeters in diameter, respectively.

Oblong drum chambers 129, 130, 133 and 135 have 5 millimeter, 7.5 millimeter, 5 millimeter, and 7.5 millimeter radius' at either end, respectively, and have 10 millimeter, 15 millimeter, 10 millimeter, 15 millimeter widths, respectively.

Figure 3:
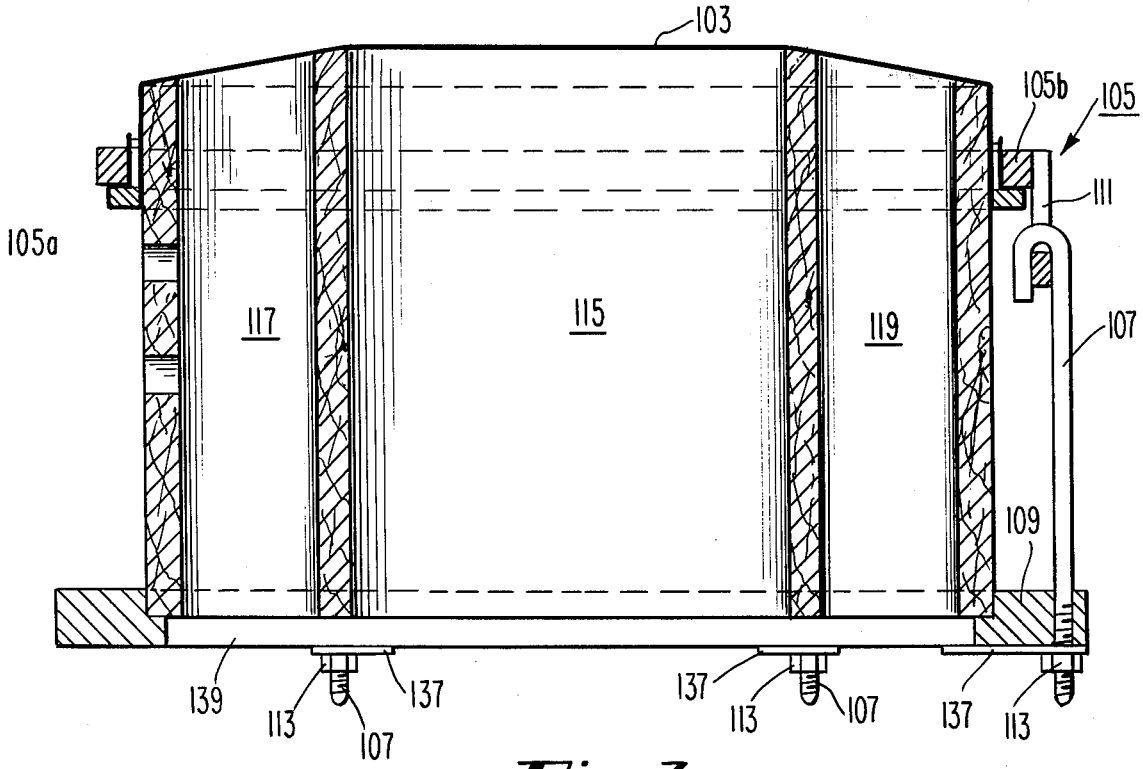
FIG. 3 is a cross sectional view through the drum taken as shown in FIG. 2.

While each of the percussion chambers described above and discussed in further detail below in connection with FIG. 3, is characterized with respect to its cross sectional shape, it is understood that these percussion chambers are each cylinders extending through the housing 101 parallel to one another and to the outer cylindrical wall of this housing 101. The drum 100 produced thereby is not simply a grouping of individual drums but is in fact a compound drum under a signal head 103 having a continuous housing 101 and therefore providing contiguous drum elements. A sound produced by beating the head 103 above a particular percussion chamber not only vibrates through that chamber but passes certain sounds through the interior side walls of the housing 101 into adjacent percussion chambers. Complex harmonics are produced which provide an overall drum instrument 100 with an extended range of frequencies (sounds) unavailable with any other instrument. Moreover, depending on the shape of the various percussion chambers and their position relative to one another, numerous frequency ranges become available, whether they be continuous ones or discontinuous ones with certain tone "holes" in them. The subject invention provides a multitude of drum sounds from but a single instrument and from a single continuous drum head.

Obviously, by varying the various thicknesses of the interior walls of the housing 101 and by thus varying the distances and spaces between the various percussion chambers, the possible sounds produced by the drum 100 may be altered. Moreover, as the housing 101 is made of different materials or different combinations of materials. Whether it be of a single block of wood, or a laminated structure of various woods, or a casting of a single metal, or a complex casting of various metals, or an injection molding of a single or a plurality of polymer materials, the sound production capabilities of the drum 100 are altered. If the drum percussion chambers are formed with irregular wall surfaces, wall surfaces which are bowed out as an example, as in a conga drum, the sound produced by the instrument is also altered.

Additionally, some of the drum chambers may also be formed to intersect one another so that by beating on one chamber, as an example, small round percussion chamber 127, the sound also vibrates directly into large center percussion chamber 115, different frequencies would be available from this alternate version of the musical instrument as are from the principle embodiment. Similarly, an alternate design for the housing 101 could incorporate a sound plenum at the bottom of the drum joining certain of the various percussion chambers.

As to the preferred embodiment described above in connection to FIG. 3, each of the percussion chambers extends longitudinally, and entirely through the housing 101, FIG. 3. The playing end of the housing forms a truncated frustroconical section with a flat plane at the center percussion chamber 115 and a tapered conical section extending over the other chambers 117, 119, 121, 123, 125, 127, 129, 131, 133 and 135. This truncated conical end is formed by permitting the inner wall portions of the housing 101 to extend increasingly further out from the point where the outer surface of the housing ends.

A single drum head 103, "skin", is stretched over the truncated conical playing end of the housing 101. Tensioning rim 105, FIG. 3, includes an inner rectangular cross sectioned ring 105*a* of a large enough diameter to be slipped over the outside of the housing 101 and a mating slightly larger ring 105*b*. Larger ring 105*b* has an L-shaped cross section forming a cutout portion for mating with the inner ring 105*a*. Extending from this outer ring 105*b* are the six V-shaped loops 111 for mating with one each of the six tensioning rods 107. The head 103 is slipped inside the inner ring 105*a* and wrapped about it to be clamped against that ring by the clamping action of the outer ring 105*b* as it is drawn toward the bottom of the drum 100 by the tensioning rods 107.

Bottom rim ring 109 is a circular plate with a large circular center hole therethrough. The outer diameter of the bottom rim ring 109 is large enough to permit the ring 109 to extend beyond the outer surface of the housing 101 enabling clamping holes to be drilled therethrough for receiving the threaded end of the tensioning rods 107. Typically, center hole 110 is of a large enough dimension so that it does not cover the bottom end of any of the percussion chambers. Each of the tensioning rods 107, as stated above, are secured to the bottom rim ring 109 by a nut 113.

As the drum housing 101 can be made of various materials as discussed above, so can the tensioning ring 105, the tensioning rods 107, and the bottom ring 109. These elements can be made of wood, metal or plastic. In the preferred embodiment these elements are made of metal. The tensioning rim 105 with its inner ring portion 105*a* and outer ring portion 105*b* are made of steel which provides great strength and minimal structural cross section. As with the tensioning rim 105 the V-shaped loops 111 are also of steel, each one being welded to the outer ring 105*b*. Tensioning rods 107 and their mating nuts 113 are each also of steel.

Bottom rim ring 109 need not have a small cross section. In fact, to facilitate mounting the drum 100 on a drum stand or other support, so that it may be played between the legs of the musician, it is convenient to make this rim ring of slightly larger dimensions. Therefore, for the purpose of saving weight while providing sufficient strength, this bottom rim ring 109 may be made of aluminum.

Figure 4:
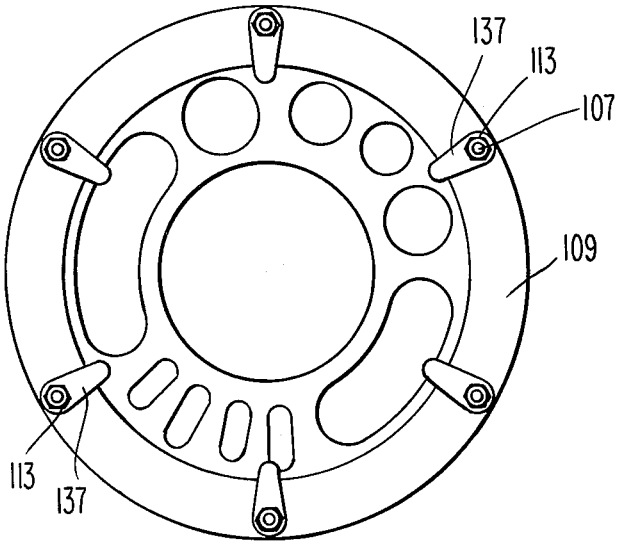
FIG. 4 shows the bottom rim for the assembled drum structure.
Figure 5:
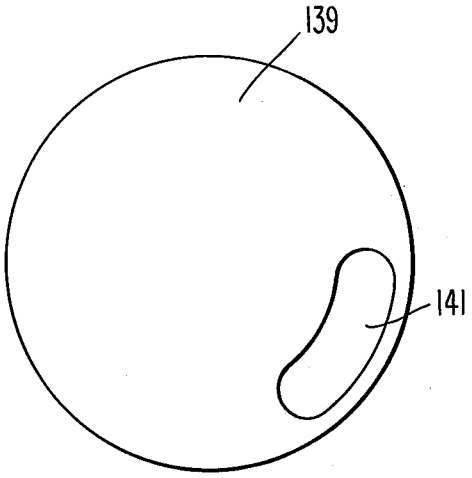
FIG. 5 shows a bottom insert plate having one of the selectable plurality of vent holes therethrough.

An oblong-shaped washer 137, FIG. 4, may be placed intermediate each nut 113 and the bottom rim ring 109. These six oblong-shaped washers 137 are each of the same size and shape and possess dimensions sufficient to extend the washer beyond the inner diameter of the bottom ring 109 when the oblong portion is turned inwardly. These washers 137 may be used to hold a bottom plate 139, FIG. 5, tightly against the bottom end of the housing 101. This plate 139 is of a circular dimension to fit neatly inside the bottom rim ring 109.

Bottom plate 139 is used to mute the drum 100. As such it may be a solid flat plate or may have one or more holes extending therethrough. As an example, this plate may have a hole 141 extending through it which when the plate is positioned over the drum 100, mates with the cross section of a particular percussion chamber 119 to leave that end of that chamber open while closing the bottom ends of the other chambers. Alternately, more of these percussion chambers may be vented through the bottom plate 139. Alternately, bottom plate 139 could have a particular configuration of very small screen-like vent holes therein. By adjusting the size, number and shape of the vent holes in this plate 139, the acoustical or musical characteristics for the drum 100 can be changed.

This drum invention is intended to be played as a conga, bongo or snare drum is played (i.e., between the legs of the musician or on a snare drum stand standing or sitting). The flat center portion of the head provides a flat drum surface for the musician to work with. The tapered conical portion gives him an additional surface easily and tactily recognizable whereby he may locate the other percussion chambers or drums within the drum.

The angle at which the tapered portion of the head tapers is a function of what would be comfortable to the hand of the drummer. Typically, an angle of from 5 to 30 degrees from the horizontal is chosen. Too great an angle would create too sharp a breakpoint upon which the drummer would jam the palm-knuckle portion of his hand. Too shallow an angle would eliminate the pinch point created by the change in direction of the head and would eliminate the tactile advantage of the design and reduce the variable tensioning features of the head. By providing a breakpoint wherein the head slopes from the horizontal at an angle, a circular pinch point on the head is formed about the rim of the center large percussion chamber 115. The head 103 may be adjusted for different tensions at different areas of the drum by taking up on various nuts 113, differently. Unlike a standard drum, which has a single planer drum head wherein tensioning one of the tension rods, while taking up greatly in that area also transmits tensional forces to all areas of the drum, tensioning one of the tensioning rods 107 of the present invention does not similarly transmit tension to all areas of the drum. The break or change in direction of the drum head about the rim of the center percussion chamber 115 provides a pinch point which not only tends to dampen the sound vibration of the head 103, but also acts to isolate the various areas of the head 103 for tensioning purposes.

It is to be understood that the foregoing sets forth illustrative embodiments of the present invention. Many other embodiments may be developed without departing from the intent or scope of this invention. It is intended, therefore, that this disclosure be considered in the illustrative sense and not be taken in the limiting sense.

What is claimed:

1. A drum comprising:

a cylindrically-shaped housing, one end thereof terminating as a truncated frustroconical-shaped end, comprising a contiguous plurality of percussion chambers whereof:

a first circularly-shaped percussion chamber extends longitudinally through said housing, having an opening onto the flat portion of said truncated frustroconical end;

a pair of kidney-shaped percussion chambers each extend logitudinally through said housing, oppositely positioned about the periphery of said first circularly-shaped chamber, each having an opening thereof onto the tapered portion of said truncated frustroconical end;

a plurality of oblong-shaped percussion chambers extend logitudinally through said housing, each having an opening thereof grouped onto said tapered portion of said truncated frustroconical end, peripherally about said first circularly-shaped percussion chamber, and between said pair of kidney-shaped chambers;

a plurality of small circularly-shaped percussion chambers extending longitudinally through said housing, each having an opening thereof grouped into said tapered portion of said truncated frustroconical end, about the periphery of said first circularly-shaped percussion chamber opposite said plurality of oblong-shaped percussion chambers; and a single drum head completely covering said housing truncated frustroconical-shaped end.

2. A drum comprising:

means for defining a continuous drum body member having at least one sound generating end thereof, said end presenting plural chambers; and a single drum head completely covering said body member defining means sound generating end, said drum head presenting a plurality of distinct face surfaces.

3. A drum, comprising:

a drum housing having a plurality of percussion chambers formed therein; and a single head completely covering one end of said chambers.

4. The drum of claim 3 wherein said drum housing comprises a single continuous structure.

5. The drum of claim 4 wherein said head covers completely said single continuous structure, said head covered end thereof having a plurality of individual chamber head covered face surfaces.

6. The drum of claim 5 wherein said head includes a sound dampening pinch point between at least two of said plural face surfaces.

7. The drum of claim 6 wherein said percussion chambers extend contiguously, parallel to one another, through said housing, various walls of said chamber walls extending at various distances to establish said plural faced head covered end thereof.

8. The drum of claim 7 wherein said plurality of percussion chambers differ in cross sectional area and cross sectional size each of said chambers extending completely through said housing.

9. The drum of claim 8 also including a baffle plate covering the opposite end of said housing from the head covered end.

10. The drum of claim 9 wherein said baffle plate includes a hole therethrough which location coincides with the opening of at least one of said percussion chambers onto said opposite end.

* * * * *